US005186141A

United States Patent [19]

Custer

[11] Patent Number: 5,186,141

[45] Date of Patent: Feb. 16, 1993

[54] ENGINE BRAKE TIMING CONTROL MECHANISM

[75] Inventor: Dennis R. Custer, West Granby, Conn.

[73] Assignee: Jacobs Brake Technology Corporation, Wilmington, Del.

[21] Appl. No.: 880,369

[22] Filed: May 4, 1992

[51] Int. Cl.[5] ..... F02D 13/04

[52] U.S. Cl. ..... 123/321; 123/90.16

[58] Field of Search ..... 123/90.16, 321, 322

[56] References Cited

U.S. PATENT DOCUMENTS 4,398,510 8/1983 Custer ..... 123/321 X 4,706,625 11/1987 Meistrick et al. ..... 123/321

5,105,782 4/1992 Meneely ..... 123/321

*Primary Examiner*—Tony M. Argenbright

*Attorney, Agent, or Firm*—Robert R. Jackson

[57] ABSTRACT

In a compression release engine brake, the starting point for the forward stroke of the slave piston is automatically adjusted when the engine brake is turned on, e.g., to remove the clearance which is typically provided between the slave piston and the associated internal combustion engine exhaust valve mechanism. Two elements in the engine brake move apart during the first forward stroke of the slave piston. Hydraulic fluid enters a chamber formed between these two members and is tarpped there when the returning slave piston closes the aperture through which the fluid entered that chamber. The return strokes of the slave piston are thus foreshortened. The closing of the above-mentioned aperture by the slave piston constitutes the sole means by which hydraulic fluid is trapped in the chamber. No other check valve element is required.

11 Claims, 2 Drawing Sheets

ENGINE BRAKE TIMING CONTROL MECHANISM

BACKGROUND OF THE INVENTION

This invention relates to compression release engine brakes, and more particularly to devices for controlling the timing of the compression release event in such engine brakes.

Compression release brakes for internal combustion engines are well known as shown, for example, by Custer U.S. Pat. No. 4,398,510. As the '510 patent points out, it is typical to set the starting point for motion of the slave piston in such brakes at a predetermined distance from the exhaust valve surface on which that slave piston operates to allow for thermal expansion of the exhaust valve. Without such a clearance, when the engine became hot, the slave piston would hold open the associated exhaust valve at all times, thereby decreasing the fueling mode power available from the engine and also possibly causing damage to the engine. On the other hand, improved engine brake performance can be achieved by eliminating this clearance (or even going to a negative clearance) during engine braking mode. The '510 patent therefore shows a timing mechanism built into the slave piston return stop screw. This timing mechanism automatically extends from the return stop screw by a predetermined amount during the first cycle of engine brake operation each time the engine brake is turned on. Once extended, the timing mechanism remains in that condition as long as the engine brake is turned on. The extended timing mechanism takes up as much of the original clearance as is desired, and may even extend more than the original clearance in order to provide a negative clearance if that is desired. When the engine brake is turned off, the timing mechanism retracts so that there is no danger of the engine brake holding open the exhaust valves when fueling of the engine resumes.

The timing mechanism shown in the '510 patent is extended by a spring in the timing mechanism. The amount of extension is determined by the dimension of a transverse slot in the timing mechanism through which a pin passes. Once the timing mechanism is extended, it is held extended by hydraulic fluid (typically engine oil being used in the hydraulic circuit of the engine brake) trapped behind the timing mechanism by a ball check valve. When the engine brake is turned off, this trapped oil leaks away and the timing mechanism is pushed back into the slave piston return stop screw by the slave piston return spring.

While the timing mechanism shown in the '510 patent works extremely well, it has some problems and there is room for further improvement. The timing mechanism of the '510 patent has a relatively large number of relatively small precision parts. For example, the '510 patent mechanism has a relatively small plunger which must reciprocate in a bore in the slave piston return stop screw without allowing too much leakage of oil around the plunger. The plunger also requires a seat for the relatively small ball check valve. The ball check valve and an associated spring must be provided. The transverse slot in the plunger must be precisely located and formed in order to ensure the correct amount of extension of the plunger. The transverse pin must be mounted securely to ensure that it cannot come out. A reverse push test may be required to ensure that the pin is in fact secure. All of these considerations make the '510 patent mechanism relatively difficult and expensive to manufacture.

The '510 patent mechanism may also have some shortcomings in use. For example, the slave piston return stop screw may be hollow near the nut which is used to lock the screw in place in the engine brake housing. Over-tightening of this nut may therefore cause the screw to break. The relatively small size of the plunger may cause very large hydraulic pressures to develop inside the screw under some conditions. This may also cause the screw to break just below the above-mentioned nut.

In view of the foregoing, it is an object of this invention to improve and simplify engine brake timing mechanisms of the general type shown in the '510 patent.

It is another object of this invention to provide an engine brake timing mechanism which has fewer parts than the '510 patent mechanism, which is easier and cheaper to manufacture than the '510 patent mechanism, and which is easier and more reliable to use than the '510 patent mechanism.

It is still another object of this invention to provide an engine brake timing mechanism which is not subject to the high internal hydraulic pressure which can occur in the '510 patent mechanism.

SUMMARY OF THE INVENTION

These and other objects of the invention are accomplished in accordance with the principles of the invention by providing an engine brake timing mechanism in which the contact between the plunger and the associated slave piston provides the check valve effect for keeping the hydraulic fluid trapped behind the plunger so that no separate ball or other check valve is required. The mechanism of this invention is designed so that the hydraulic pressure behind the plunger is relatively low, and preferably substantially lower than the pressure in the gap between the plunger and the slave piston as the slave piston returns toward the plunger. For example, this may be accomplished by forming the plunger as a relatively large cup around the outside of an unthreaded lower portion of the slave piston return stop screw, rather than as a relatively small reciprocating element inside that screw as in the '510 patent. The part of the plunger around the orifice which admits hydraulic fluid to the region behind the plunger is shaped to seal the orifice against the adjacent surface of the returning slave piston. This part of the plunger is also preferably shaped and sized so that the hydraulic pressure in the closing gap between this part of the plunger and the returning slave piston is substantially higher than the hydraulic pressure behind the plunger. This relatively high pressure immediately outside the plunger orifice helps to prevent hydraulic fluid behind the plunger from escaping, at least for the relatively short time period between slave piston strokes. The plunger is preferably held on the slave piston return stop screw by a substantially annular snap ring which bridges annular grooves in the plunger and screw. The thickness of this ring and the widths of the grooves control the amount of plunger extension. If, as is preferred, the plunger is a cup outside the screw rather than a member inside the screw, much more of the screw can be left solid, which makes the mechanism of this invention more robust than the '510 patent mechanism.

Further features of the invention, its nature and various advantages will be more apparent from the accompanying drawings and the following detailed description of the preferred embodiments.

DETAILED DESCRIPTION OF THE PREFERRED EMBODIMENTS

Although those skilled in the art will appreciate that the principles of this invention are usable in engine brakes having other configurations, the invention will be fully understood from the following explanation of its use in an engine brake of the type shown in the '510 patent. Because the '510 patent is hereby incorporated by reference herein, it will not be necessary to repeat what is shown and described in that patent. So that there will be no doubt on this score, however, it is noted that from the standpoint of how the engine brake operates to brake the associated internal combustion engine, there is no difference between whether timing mechanisms of type shown in the '510 patent or timing mechanisms of the type shown here are employed. The timing mechanisms shown here can be designed to provide any of the engine brake operating characteristics which the '510 patent mechanisms can provide. As just one example of this, both the '510 patent mechanisms and the present mechanisms can provide positive, zero, or negative clearance between the slave piston and the associated exhaust valve when the engine brake is in operation as described in the '510 patent.

Figure 1:
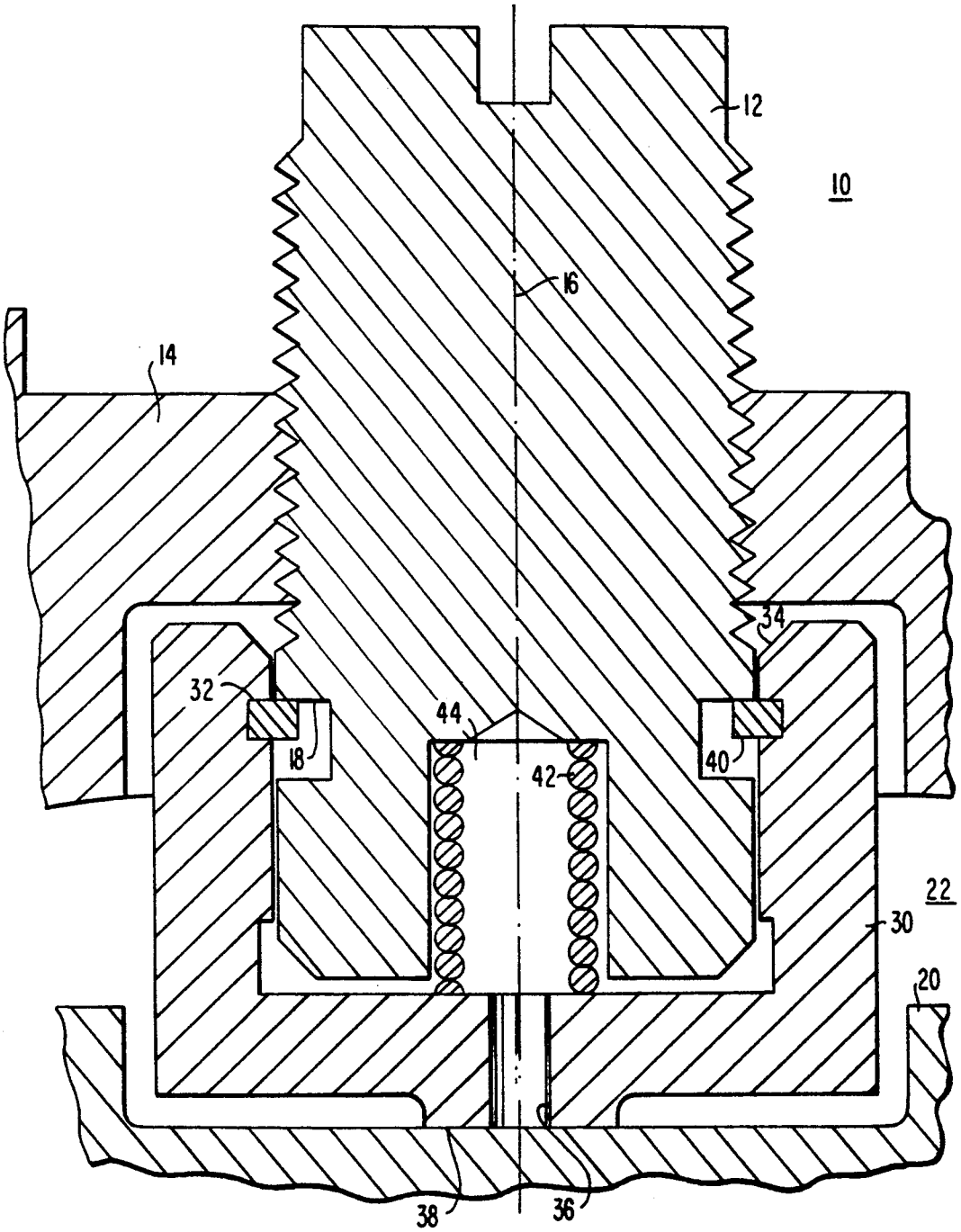
FIG. 1 is a simplified sectional view of an illustrative embodiment of the timing mechanism of this invention while the associated engine brake is turned off.

Referring now to FIG. 1, a preferred embodiment of the timing mechanism 10 of this invention includes a slave piston return stop screw 12 threaded through the housing 14 of the engine brake above the top of an associated slave piston 20. A nut (not shown) is typically threaded on screw 12 above housing 14 to lock screw 12 in place with the desired amount of projection into housing 14.

Cup-shaped plunger 30 is mounted on the unthreaded lower portion of screw 12 for reciprocation parallel to the longitudinal axis 16 of the screw. Plunger 30 fits sufficiently closely around screw 12 to prevent all but relatively slow leakage of hydraulic fluid (typically engine oil) between those parts, but not so closely as to prevent the above-described reciprocation of the plunger. Plunger 30 is held on screw 12 by a substantially annular snap ring 40 which bridges annular groove 18 on the outside of screw 12 and annular groove 32 on the inside of cup 30. The sum of the widths of grooves 18 and 32 parallel to axis 16, minus the thickness of ring 40 also parallel to axis 16, is the amount by which plunger 30 moves relative to screw 12 to extend during engine braking as described below. Ring 40 and grooves 18 and 32 preferably maintain some clearance between the lower end of screw 12 and the inside surface of the bottom of plunger 30 even when the plunger is fully retracted as shown in FIG. 1. This ensures easy flow of hydraulic fluid into the chamber formed between the lower end of screw 12 and the inside of plunger 30. Plunger 30 is resiliently urged to extend relative to screw 12 by prestressed compression coil spring 42 which is disposed in a relatively short longitudinal bore 44 in screw 12. When the engine brake is off, the force of spring 42 is overcome by the force of the conventional slave piston return spring (not shown), thereby retracting plunger 30 to the position shown in FIG. 1.

Plunger 30 and spring 42 are assembled on screw 12 by first placing snap ring 40 in groove 18. Then, with spring 42 in bore 44, plunger 30 is pushed on the lower end of the screw. The frustoconical surface 34 on the inside of the upper edge of the plunger temporarily annularly compresses snap ring 40, thereby allowing the plunger to pass over the ring. When groove 32 reaches ring 40, the ring snaps out into that groove and permanently secures the plunger to the screw.

The center of the bottom of plunger 30 has a longitudinal aperture or bore 36 extending from the interior of the plunger to its bottom outer surface. When slave piston 20 moves down away from plunger 30 during engine brake operation, spring 42 initially causes plunger 30 to move down with the slave piston. Aperture 36 allows hydraulic fluid from the cylinder 22 in which slave piston 20 reciprocates to flow into the interior of plunger 30 and thereby keep the enlarging cavity inside the plunger full of such fluid. Plunger 30 reaches the downward limit of its travel when the lower surface of ring 40 contacts the lower surface of groove 18, while the upper surface of ring 40 contacts the upper surface of groove 32. Slave piston 20 typically continues to travel down after the downward motion of plunger 30 has thus been stopped.

Figure 2:
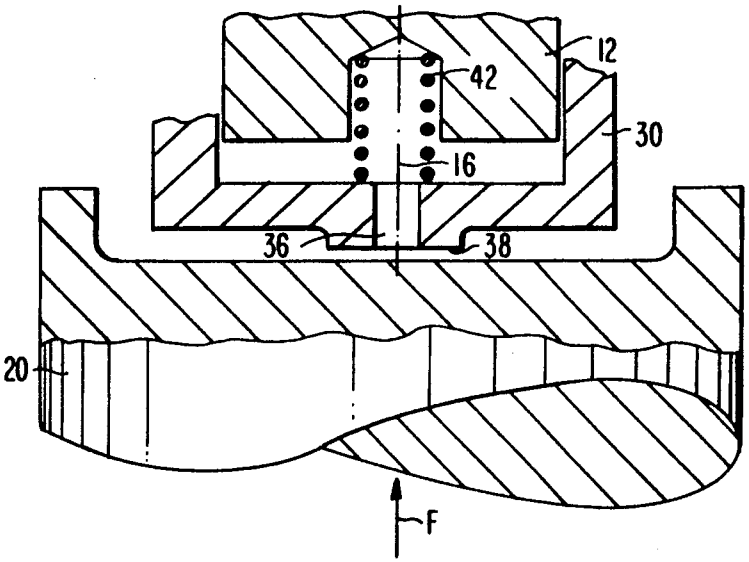
FIG. 2 is a view similar to a portion of FIG. 1 showing another operating condition of the apparatus.
Figure 3:
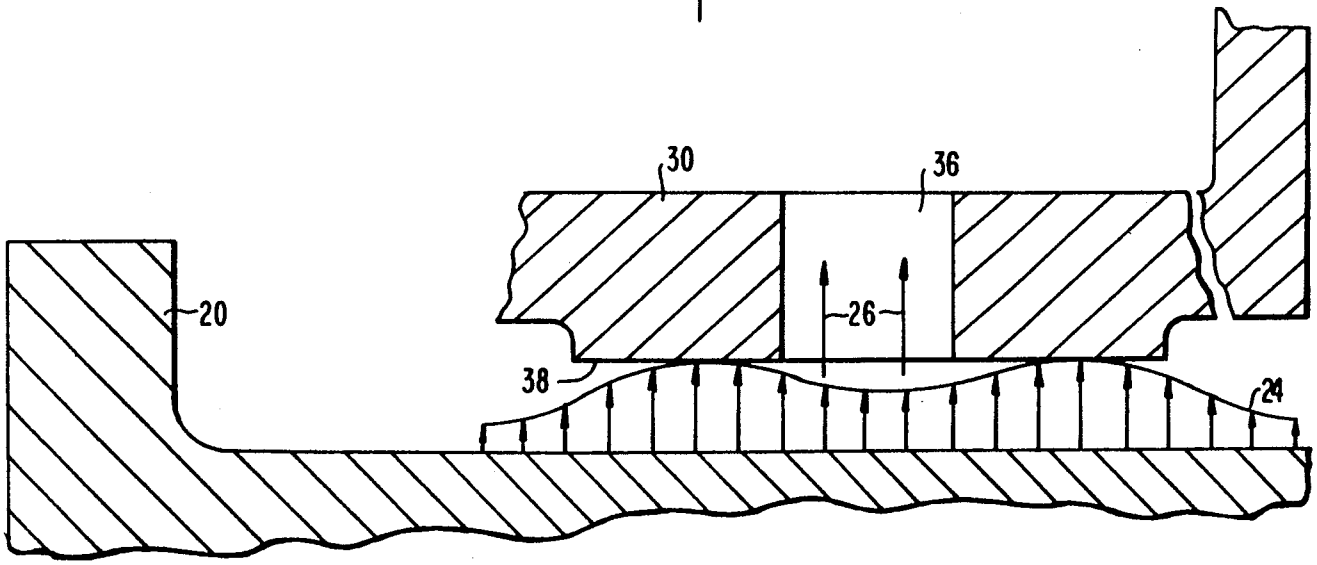
FIG. 3 is an enlargement of a portion of FIG. 2 showing a hydraulic pressure gradient and hydraulic fluid flow lines which are useful in explaining the operation of the apparatus.

When the hydraulic pressure in cylinder 22 is somewhat relieved after a compression release event has been produced in the associated internal combustion engine, slave piston 20 begins to move up again toward plunger 30. This condition of the apparatus is shown in FIGS. 2 and 3. The upward force F on slave piston 20 is produced by the above-mentioned slave piston return spring (not shown). When the upper surface of slave piston 20 comes close to the lower surface of plunger 30, slave piston 20 tries to push plunger 30 up. At the same time, however, the upper surface of slave piston 20 acts to close aperture 36, thereby substantially preventing the hydraulic fluid inside plunger 30 from escaping. This prevents plunger 30 from moving up, and so slave piston 20 comes to rest against the extended plunger exactly as in the '510 patent.

When it is time for the next compression release event to be produced by slave piston 20, the slave piston starts its forward stroke from the displaced position established by extended plunger 30, thereby advancing that next compression release event. The seal between the lower surface of plunger 30 around aperture 36 and the upper surface of slave piston 20 is good enough to keep substantially all of the hydraulic fluid admitted to the interior of the plunger trapped during the relatively brief time intervals between slave piston strokes. For example, the time interval between slave piston stokes in an engine brake operating at 2100 RPM is only about 30 milliseconds. No separate check valve such as the ball check valve used in the '510 patent is required to keep the hydraulic fluid thus trapped inside plunger 30.

Considering the valving effect of slave piston 20 on aperture 36 in somewhat more detail, in the depicted preferred embodiment the portion 38 of the lower surface of plunger 30 which can contact the upper surface of plunger 20 has a substantially smaller area "a" than the opposite inner surface of the plunger. As the returning slave piston approaches this surface, the average pressure P in the film of hydraulic fluid in the gap between plunger surface portion 38 and the upper surface of the slave piston is given by the equation $P=F/a$. The hydraulic pressure inside plunger 30, on the other hand, is given by the equation $P=F/A$, where A is the area of the inside bottom surface of plunger 30. Because A is much larger than "a", the developing seal between surface 38 and slave piston 20 is highly effective to prevent hydraulic fluid from escaping from plunger 30 via aperture 36. Indeed, small amounts of hydraulic fluid tend to flow from the film between elements 20 and 38 into aperture 36. This is illustrated by FIG. 3 which shows a typical hydraulic fluid film pressure gradient 24 between elements 20 and 38, and which also shows (by way of lines 26) the tendency of some hydraulic fluid to flow from this film into aperture 36.

The above-described operation of the timing mechanism of this invention is aided by the fact that because the area A is larger than the comparable area in mechanisms of the type shown in the '510 patent, the hydraulic pressure inside plunger 30 tends to be much lower than the hydraulic pressure behind the plunger in the '510 patent mechanism. This is desirable not only to help slave piston 20 seal aperture 36, but also to reduce the risk of damage to slave piston return stop screw 12. The risk of damage to this screw is also greatly reduced by the fact that it is bored out to a much lesser extent that the screw in the '510 patent mechanism. Indeed, as shown in FIG. 1, screw 12 can easily be left completely solid near the interface between housing 14 and the nut which is placed on screw 12 above the housing in order to lock the screw in place. Screw 12 is therefore much less likely to break, even if this nut is over-tightened, than the screw in the '510 patent mechanism.

The mechanism of this invention also has several other advantages over the '510 patent mechanism. For example, the cross pin in the '510 patent mechanism is replaced by more reliable and more easily and cheaply assembled retaining ring 40. The effective hydraulic area in the present mechanism is greatly increased by use of an external cup 30 rather than an internal plunger. For example, the area A in the present mechanism can easily be four times the corresponding area in the '510 patent mechanism. This reduces internal pressure for a given load by a factor of four. It also reduces lap fit leakage between elements 12 and 30 by a factor of approximately two. The cylindrical parts in the present mechanism require no cross holes. No cross pin and related assembly fixtures are required. Internal components and assembly movements are reduced (i.e., there is no ball, ball spring, or eyelet). The precision bore in cup 30 is larger in diameter and shorter in length than in the screw in the '510 patent. This surface is therefore easier to grind. The precision outside diameter on screw 12 may be through-feed centerless ground right across the threaded portion for fast, consistent production. There is no ball seat to form. The tolerance on the amount of extension of plunger 30 is controlled by the stack up of tolerances on grooves 18 and 32 and the thickness of the retaining ring. All of these individual tolerances are relatively easy to hold.

It will be understood that the foregoing is merely illustrative of the principles of the invention, and that various modifications can be made by those skilled in the art without departing from the scope and spirit of the invention. For example, the above-mentioned area "a" can be controlled relative to area A by appropriately shaping the lower surface of plunger 30 as shown in FIG. 1, by alternatively shaping the upper surface of slave piston 20, or as still another alternative by appropriately shaping both of these surfaces.

The invention claimed is:

1. A slave piston return stop mechanism for use in a compression release engine brake for automatically adjusting the location at which the return stroke of a slave piston in the brake stops when the engine brake is turned on comprising:

a first member having a surface which can contact a surface of said slave piston, said first member being mounted for limited reciprocal motion parallel to the reciprocation of said slave piston;

a second member which is stationary relative to the reciprocation of said slave piston, said second member cooperating with said first member to form a chamber for containing hydraulic fluid between said first and second members;

means for resiliently urging said first member to move toward said surface of said slave piston; and an aperture through said first member to said chamber, said aperture passing through said surface of said first member so that said aperture is closed when said surface of said first member is in contact with said surface of said slave piston in order to trap hydraulic fluid in said chamber, said contact between said surface of said first member and said surface of said slave piston being the sole means by which said aperture is closed.

2. The apparatus defined in claim 1 wherein said second member comprises a longitudinal member having a longitudinal axis substantially parallel to the axis of reciprocation of said slave piston, wherein said first member is a cup-shaped member mounted over an axial end of said second member with the bottom of the cup shape transverse to the axis of reciprocation of said slave piston and adjacent said surface of said slave piston.

3. The apparatus defined in claim 2 wherein said aperture passes through the bottom of said cup shape, and wherein said surface of said first member and said surface of said slave piston are both transverse to the axis of reciprocation of said slave piston.

4. The apparatus defined in claim 3 wherein the area of said surface of said first member is substantially less than the area of the bottom of said cup shape inside said chamber.

5. The apparatus defined in claim 1 wherein said means for resiliently urging comprises a prestressed compression spring disposed between said first and second members.

6. The apparatus defined in claim 5 wherein said spring is disposed in said chamber.

7. The apparatus defined in claim 1 wherein said first member has a first groove having a predetermined width substantially parallel to the axis of reciprocation of said slave piston, wherein said second member has a second groove having a predetermined width substantially parallel to the axis of reciprocation of said slave piston, said first and second grooves communicating with one another, and wherein said apparatus further comprises a third member disposed in said first and second grooves and having a predetermined thickness substantially parallel to the axis of reciprocation of said slave piston which is substantially less than the width of at least one of said first and second grooves for limiting said reciprocation of said first member.

8. The apparatus defined in claim 7 wherein said second member is a longitudinal member having a longitudinal axis substantially parallel to the axis of reciprocation of said slave piston, wherein said first member is a cup-shaped member mounted over an axial end of said second member with the bottom of the cup shape transverse to the axis of reciprocation of said slave piston and adjacent said surface of said slave piston, wherein said first groove is an annular groove around the inside of the side of the cup shape, wherein the second groove is an annular groove around the outside of said second member, and wherein said third member is a substantially annular member.

9. The apparatus defined in claim 8 wherein said third member is annularly resilient and temporarily annularly compressible to facilitate mounting said first member on said second member.

10. The apparatus defined in claim 2 wherein said means for resiliently urging comprises a prestressed compression spring partly disposed in an axial bore in said end of said longitudinal member and also acting on the inside of the bottom of the cup-shaped member.

11. The apparatus defined in claim 2 wherein said slave piston reciprocates in a slave piston cylinder formed in a housing, and wherein said longitudinal member is mounted in said housing for adjustment parallel to said longitudinal axis.

* * * * *